United States Patent [19]

Lockhart et al.

[11] Patent Number: 5,012,755

[45] Date of Patent: May 7, 1991

[54] APPARATUS FOR TENSIONING A SAIL

[75] Inventors: Reed Lockhart, Sai Kung, Hong Kong; Barry Spanier, Kahului, Hi.

[73] Assignee: Neil Pryde Limited, Hong Kong

[21] Appl. No.: 373,151

[22] Filed: Jun. 28, 1989

[30] Foreign Application Priority Data

Jul. 5, 1988 [GB] United Kingdom ..... 8815945

[51] Int. Cl.[5] ..... B63H 9/04

[52] U.S. Cl. ..... 114/103

[58] Field of Search ..... 114/102, 103; 248/188.4

[56] References Cited

U.S. PATENT DOCUMENTS

| | | | |
|---|---|---|---|
| 1,362,950 | 12/1920 | Ljungstrom | 114/103 |
| 2,831,447 | 4/1958 | Hanna | 114/102 |
| 3,104,493 | 9/1963 | Nalle | 248/188.4 |
| 3,444,834 | 5/1969 | Bever et al. | 114/102 |
| 4,602,585 | 7/1986 | Hackney | 114/103 |
| 4,625,671 | 12/1986 | Nishimura | 114/103 |
| 4,633,798 | 1/1987 | Skinner et al. | 114/107 |
| 4,686,921 | 8/1987 | Magnan | 114/103 X |

FOREIGN PATENT DOCUMENTS

| | | |
|---|---|---|
| 2463719 | 8/1979 | France . |
| 639952 | 7/1950 | United Kingdom . |
| 1316659 | 5/1973 | United Kingdom . |
| 2196310 | 4/1988 | United Kingdom . |

*Primary Examiner*—Sherman Basinger

*Attorney, Agent, or Firm*—Willian, Brinks, Olds, Hofer, Gilson & Lione

[57] ABSTRACT

A sail for a sailboard is tensioned by use of a batten inserted in a pocket having closed ends. The batten has end cap having a tip on a screw for adjusting the overall length of the batten.

2 Claims, 1 Drawing Sheet

APPARATUS FOR TENSIONING A SAIL

INTRODUCTION

The present invention relates to apparatus for tensioning a sail. The invention is particularly applicable to sails for sailboards or windsurfers, but may be used with other sails, such as for hangliders, sailing boats, etc.

BACKGROUND

In order to create and stabilize the aerodynamic shape of a sail, it is known to insert a batten into a pocket on the sail. The pocket generally extends from the trailing edge of the sail. The pocket is open at one end, on an edge of the sail, and the batten is forced into the pocket by means of a strap on the sail which cooperates with a friction buckle at the open end of the pocket to hold the batten in the pocket and so tension the sail along the length of the pocket. Other methods are known for securing the batten in the pocket. The batten and pocket may extend across the full width of the sail. A drawback of this system is that it results in having a strap hanging loose at the trailing edge of the sail and, to ensure adequate batten length for tensioning the sail as it stretches through use, the batten is made significantly longer than the pocket and hence projects beyond the sail edge. The protruding batten and flapping strap are unsightly and also create drag which reduces the efficiency of the sail.

SUMMARY OF THE INVENTION

A first aspect of the invention provides tensioning apparatus for a sail, the tensioning apparatus comprising an elongate pocket formed on the sail, the pocket being closed at opposite ends thereof, and a tensioning batten housed in the pocket, the batten being longer that the distance between the pocket ends in the untensioned sail, thereby to tension the sail in the region of the pocket, wherein means is provided for adjusting the length of the batten.

Preferably the pocket is provided with a fastenable opening along its length for insertion and removal of the batten.

A second aspect of the invention provides a batten adapted for tensioning a sail, the batten being insertable into a pocket in the sail to tension it, wherein the length of the batten is adjustable.

The batten may comprise a first batten portion and an end cap mounted on the batten portion, the end cap having a means for attaching it to an end of the batten portion, and a body part which extends beyond the end of the batten portion. The end cap may be selectable from a number of end caps having body parts of different length.

Preferably, the effective length of the body part is adjustable.

A third aspect of the invention provides an end cap for a sail tensioning batten, the end cap increasing the effective length of the batten. Preferably the length of the end cap is adjustable.

The batten length can be adjusted to provide the optimum sail tension and to match any stretch in the sail fabric during use. Hence, the initial batten length can be tailored more closely to the pocket length than in the prior art system described above, for example.

Yet another aspect of the invention provides tensioning apparatus for a sail, the tensioning apparatus comprising an elongate pocket on the sail, the pocket being closed at opposite ends thereof, and a batten housed in the pocket and arranged to urge the pocket ends apart to tension the sail.

Other preferred features and advantages of the invention will be apparent from the following description and the accompanying claims.

DESCRIPTION OF THE PREFERRED EMBODIMENT

Figure 1:
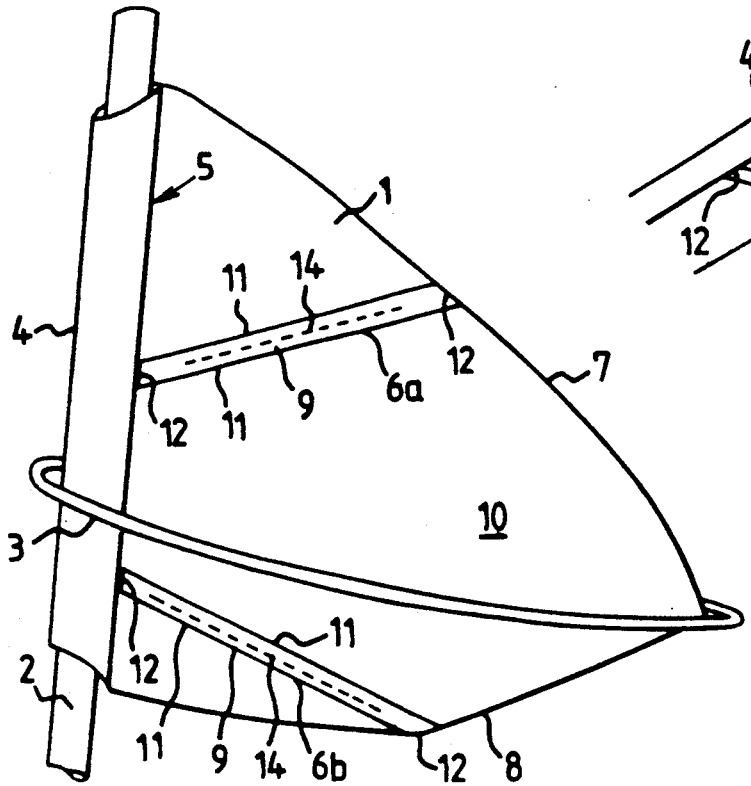
FIG. 1 is a schematic view of a sail incorporating a tensioning apparatus according to the invention.

FIG. 1 of the drawings shows schematically sail 1 for a sailboard or windsurfer mounted on a mast 2 in the usual fashion. Booms 3 serve to hold the sail 1 out from the mast 2 and act as a grip for the user. A sleeve 4 on the leading edge 5 of the sail encircles the mast 2 and straps or ropes (not shown) hold the sleeve and booms in position along the mast 2. Two pockets 6*a*, 6*b* are formed on the sail and extend respectively from the trailing edge 7 to the leading edge 5, and from mid way along a bottom edge 8 to the leading edge 5.

Figure 2:
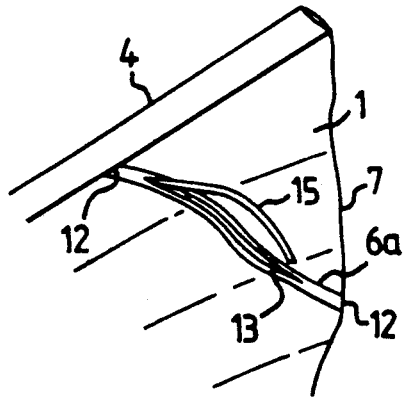
FIG. 2 illustrates the insertion of a batten into a pocket in the apparatus of FIG. 1.

Each pocket 6*a*, 6*b* is formed by a strip of material 9 which is sewn onto the main fabric 10 of the sail along longitudinal edges 11 and across its ends 12. An opening 13 (FIG. 2) closed by a zip-fastener 14 is provided along the centre of the strips 9 to allow access to the space enclosed between the sail fabric 10 and the material 9, that is the inside of the pocket 6.

To stiffen or tension the sail, flexible battens 15, formed, for example, from laminated or pultruded fibre glass, are inserted in the pockets 6*a*, 6*b*. The zip 14 is opened and one end of the batten 15 is inserted through the opening 13 into a closed end 12 of the pocket 6*a*. The batten is then flexed to enable its other end to be inserted into the other end 12 of the pocket 6*a*. The batten 15 is slightly longer than the distance between the pocket ends 12 when the sail is not under tension, thus as the batten straightens it stretches the sail between the pocket ends and so tensions the sail. The zip 14 is closed so that the batten and sail will flex together in use.

It will be appreciated that the opening 13 may be closed by other releasable fasteners such as ties or a touch and hold fastener, e.g. Velcro (R.T.M).

Figure 3:
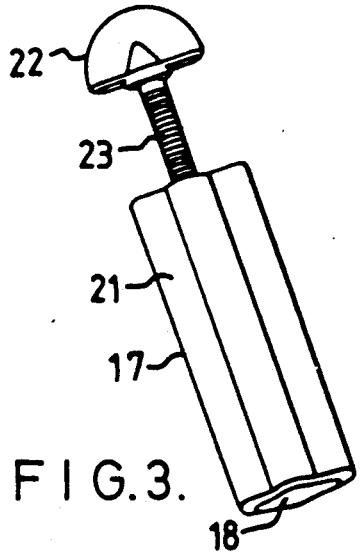
FIG. 3 shows an end cap for a batten in accordance with the invention.
Figure 4:
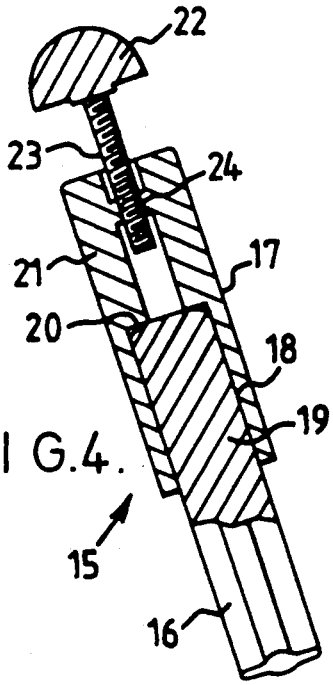
FIG. 4 is a cross-section through the end cap of FIG. 3 shown mounted on a batten.

The batten 15 is of adjustable length. Referring to FIGS. 3 and 4, the batten 15 comprises a batten portion 16 and an end cap 17 removably mounted on one end 19 of the batten portion 16.

The end cap 17 is moulded from plastics material and has a pocket 18 for snugly receiving the end 19 of the batten portion 16 to mount the end cap 17 on the batten portion 16. The end 19 abuts an inner end wall 20 of the pocket 18. A body part 21 of the end cap 17 serves to extend the length of the batten. The part 21 carries a tip 22 which, in the example, is half disc shaped and mounted on a screw 23 which is screwed into a threaded bore 24 in the body part 21. The end cap 17 may be glued onto the batten portion 16 if desired.

In use, the tip 22 can be screwed out from the body part 21 to increase the effective length of the end cap 17 and hence batten 15. In this way the length of the batten 15 can be adjusted precisely for tensioning the sail, and to compensate for any stretching of the sail as it ages.

The tip 22 and screw 23 may be mounted directly in the end 19 of a batten portion 16 to dispense with the body part 21 and pocket 18.

Instead of using the tip 22 on an end cap 17, a range of end caps with body portions 21 of different length may be provided.

Various other modifications may be made to the described embodiment. For example, a pocket 6 may be formed between two sheets of material sewn on the sail, so as to reduce the risk of damage to the sail fabric as a batten is inserted into the pocket. When a sail is made from panels of material a pocket may be formed at overlapping edges of adjacent panels.

Means for adjusting the length of the batten may be located partway along the batten. For example, the batten may be in two parts (16) which are received in pockets (18) on the opposite ends of a body (21) (cf. FIG. 4), the body (21) being of adjustable length or a range of adjusters with different body lengths being provided. The adjusting means may comprise a turnbuckle located between two batten parts (16), the buckle being mounted on oppositely threaded screws in opposed ends of the batten parts so as to move the batten parts together or apart as the buckle is turned. Also, the adjustable length batten may be used with sailboards incorporating camber inducer, in which, for example, one end of the batten projects into the sleeve of the sail and is held by a cam on the mast. It is desired to include all such modifications as fall within the scope of the accompanying claims.

What is claimed is:

1. An apparatus for tensioning a sail, the apparatus comprising:

an elongate pocket formed on and extending across the sail which is closed at both ends having a closeable opening extending substantially along the whole length of the pocket;

a batten which fits in the pocket and bears against the ends of the pocket;

means to adjust the length of the batten comprising an end cap fitted on an end of a batten portion; and means for adjusting the length of the end cap to adjust the overall length of the batten.

2. An apparatus as claimed in claim 1, wherein the end cap has a tip mounted on a screw for adjusting the length of the end cap.

* * * * *